US006536762B1

(12) United States Patent
Sheng et al.

(10) Patent No.: US 6,536,762 B1
(45) Date of Patent: Mar. 25, 2003

(54) AUTOMATIC DOCUMENT FEEDER CAPABLE OF RELEASING JAMMED DOCUMENTS

(75) Inventors: Thomas Sheng, Hsinchu (TW); Lien Szu Hui, Hsinchu (TW)

(73) Assignee: Avision Inc., Hsinchu (TW)

( * ) Notice: Subject to any disclaimer, the term of this patent is extended or adjusted under 35 U.S.C. 154(b) by 163 days.

(21) Appl. No.: 09/714,999

(22) Filed: Nov. 20, 2000

(30) Foreign Application Priority Data

Jul. 10, 2000 (TW) ..... 89211856

(51) Int. Cl.[7] ..... B65H 5/02; F16H 3/34

(52) U.S. Cl. ..... 271/273; 74/354; 271/264

(58) Field of Search ..... 271/3.2, 3.24, 271/4.04, 10.04, 264, 273, 272; 74/296, 297, 353, 354, 406

(56) References Cited

U.S. PATENT DOCUMENTS 3,935,938 A * 2/1976 Hodne ..... 74/354
3,943,786 A * 3/1976 Mills ..... 74/384
4,970,561 A * 11/1990 Mizuno ..... 74/354
5,098,210 A * 3/1992 Fujisawa et al. ..... 400/624
5,718,313 A * 2/1998 Sekine ..... 271/8.1
5,740,696 A * 4/1998 Jean et al. ..... 74/354
5,791,646 A 8/1998 Luo et al.
5,897,237 A * 4/1999 Kono ..... 271/256
6,029,969 A * 2/2000 Saitoh et al. ..... 271/186

FOREIGN PATENT DOCUMENTS

JP A3-133856 * 6/1991

* cited by examiner

*Primary Examiner*—Michael R. Mansen
(74) *Attorney, Agent, or Firm*—Rabin & Berdo, P.C.

(57) ABSTRACT

An automatic document feeder (ADF) capable of releasing jammed documents has a transmission mechanism that includes a removable transmission device. The removable transmission device is moved away and thus the transmission mechanism is disconnected when necessary. The disconnection of the transmission mechanism makes the releasing of the jammed documents much easier. The removable transmission device can be removed by the force for removing the jammed documents, or by using a spring, a leaf spring, or an electromagnetic switch.

14 Claims, 8 Drawing Sheets

AUTOMATIC DOCUMENT FEEDER CAPABLE OF RELEASING JAMMED DOCUMENTS

This application incorporates by reference Taiwanese application Serial No. 89211856, Filed Jul. 10, 2000.

BACKGROUND OF THE INVENTION

1. Field of the Invention

The invention relates in general to an automatic document feeder (ADF), and more particularly to an ADF capable of releasing jammed papers.

2. Description of the Related Art

Having the advantage of transmitting documents continuously, ADFs are widely used in photo-copy machines, facsimile machines, printers, and image scanners.

However, the problem of paper jam is a barrier of the development and application of ADFs. Many reasons can cause paper jam. Ceasing the document transmitting process suddenly is one of the main reasons. Some other reasons are more related to feeding improper document. For example, documents with improper thickness (too thick or too thin), moisture (documents with high moisture are too soft while documents with low moisture are too hard) or size or rugged documents often cause paper jam.

Typically, there is special design for easily removing the jammed documents in an ADF. Referring to FIG. 1, a conventional ADF 100 is shown. The ADF 100 contains at least three roller sets including an ADF roller set 102, a first feeding roller set 104, and a second feeding roller set 106. While the document is forwarded, it is transmitted along the transmitting directions 130*a*, 130*b*, and 130*c* and is passed through the ADF roller set 102, the first feeding roller set 104, and the second feeding roller set 106 sequentially. The appearance of the ADF 100 typically includes an upper cover 108 and a main body 110. The upper cover 108 can be opened along the direction shown by the arrow 112. The roller of the ADF roller set 102 is rotatably mounted to the upper cover 108 and the idle pulley 104*b* of the first feeding roller set 104 is also rotatably mounted to the upper cover 108.

Therefore, the ADF roller set 102 and the first feeding roller set 104 can be easily released by opening the upper cover 108 along the direction of the arrow 112. Consequently, the paper jammed in the ADF roller set 102 and the first feeding roller set 104 can be easily removed.

However, while the paper is jammed in the second feeding roller set 106, it is rather hard to be removed either along the paper transmitting direction 114 or anti-paper transmitting direction 116. Paper can be even torn up and a portion thereof is left inside the ADF 100. Hard removing of the paper jammed in the second feeding roller set 106 is mainly caused by the damping produced by the motor 120. Damping results from the magnetic force between the stator (not shown) made of magnet and the rotor (not shown) made of coil in the motor 120. The magnetic force generates great resistance while the motor 120 is driven. Further more, damping produced by the motor 120 is enhanced by the speed down design of the gears of the driven machinery. So the jammed paper in the second feeding roller set 106 is hard to be removed no matter in which direction.

Another conventional ADF is as shown in FIG. 2. The ADF in FIG. 2 contains at least three roller sets including an ADF roller set 202, a first feeding roller set 204, and a second feeding roller set 206. When the document is forwarded, it is transmitted along the transmitting directions 230*a*, 230*b*, and 230*c* and is passed through the ADF roller set 202, the first feeding roller set 204, and the second feeding roller set 206 sequentially. The first feeding roller set 204 and the second feeding roller set 206 are connected by a transmission belt and are driven by a motor 214 indirectly. The appearance of the ADF 200 typically includes an upper cover 208 and a main body 210. The upper cover 208 can be opened along the direction shown by the arrow 212. The roller of the ADF roller set 202 is rotatably mounted to the upper cover 208 and the idle pulley 204*b* of the first feeding roller set 204 is also rotatably mounted to the upper cover 208.

Therefore, the ADF roller set 202 and the first feeding roller set 204 can be easily released by opening the upper cover 208 along the direction of the arrow 212. Consequently, the paper jammed in the ADF roller set 202 and the first feeding roller set 204 can be easily removed.

However, while the paper is jammed in the second feeding roller set 206, it is rather hard to be removed either along the paper transmitting direction or anti-paper transmitting direction. Paper can be even torn up and left only a portion inside the ADF 200. Hard removing of the paper jammed in the second feeding roller set 206 is mainly caused by the damping produced by the motor 214. Damping comes from the magnetic force between the stator formed by magnet and the rotor formed by coil in the motor 214. The magnetic force generates large resistance while the motor 214 is driven. Further more, damping produced by the motor 214 is enhanced by the speed down design of the gears of the driven machinery. So the jammed paper in the second feeding roller set 206 is hard to be removed no matter in which direction.

SUMMARY OF THE INVENTION

It is therefore an object of the invention to provide an ADF, which has special design to prevent damping and the enhancement thereof resulted from the speed down design of the transmission mechanism.

According to the object of the invention, an ADF capable of releasing jammed documents is disclosed. The ADF achieves the object by disconnecting the transmission mechanism between the motor and the feeding roller set. As a result, the damping generated by the motor and the enhancement thereof is avoided.

It is therefore an object of the invention to provide an ADF capable of releasing jammed documents. The ADF capable of releasing jammed documents includes at least a feeding roller set, a motor, and a transmission mechanism connecting the feeding roller and the motor. The motor drives the feeding roller set through the transmission mechanism. The transmission mechanism includes a number of transmission devices. The ADF has the following characteristics. The transmission mechanism thereof includes at least a removable device among the transmission devices. The removable device has an away status and a working status. While the removable device is in the away status, the removable device is away from the transmission mechanism and the transmission mechanism is disconnected so that jammed documents can be removed easily.

According to a further object of the invention, a disconnecting apparatus for installing in an ADF capable of releasing jammed documents is disclosed. The ADF at least includes a transmission mechanism for transmitting the second feeding roller set. The transmission mechanism includes a number of transmission devices and one of the transmission devices is a removable transmission device. The disconnecting apparatus thereof is an elastic device, such as a spring or leaf spring, and a connecting rod. The elastic device pushes the removable transmission device away from the original position from the transmission mechanism and disconnects the transmission mechanism when necessary. The connecting rod is connected to the removable transmission device at one end and connected to the ADF at the other end so that the removable transmission device is able to move backwards and forwards by the aid of the connecting rod.

The ADF further includes an upper cover and a main body. While the upper cover is opened, the elastic device pushes the removable transmission device, such as a gear, away from the transmission mechanism and therefore disconnects the transmission mechanism. The removable transmission device is then in the away status. While the upper cover is closed, the removable transmission device returns back to the original position and is mounted with the adjacent transmission devices. Thus, the transmission mechanism is recovered and is able to transmit the second feeding roller set. The removable transmission device is then in a working status.

It is therefore an object of the invention to provide an ADF capable of releasing jammed documents. The ADF capable of releasing jammed documents includes at least one transmission mechanism connecting the second feeding roller to the motor. The motor drives the second feeding roller set through the transmission mechanism. The transmission mechanism includes a number of transmission devices. The ADF has the following characteristics. The transmission mechanism thereof includes at least a removable device among the transmission devices. The removable device has an away status and a working status. While the removable device is in the away status, the removable device is away from the transmission mechanism and the transmission mechanism is disconnected so that jammed documents can be removed easily. The removable device is removed from the transmission mechanism by the force for releasing the jammed documents.

It is therefore a further object of the invention to provide a disconnecting apparatus for installing in an ADF capable of releasing jammed documents. The ADF capable of releasing jammed documents includes at least one transmission mechanism connecting the second feeding roller to the motor. The motor drives the second feeding roller set through the transmission mechanism. The transmission mechanism includes a number of transmission devices. Among the transmission devices, at least one of which is removable. The disconnecting apparatus is an electromagnetic switch. The electromagnetic switch attracts the removable device away from the original position and thus disconnects the transmission mechanism so that jammed documents can be easily removed. After the jammed documents are removed, the electromagnetic switch pulls the removable device back to the original position and recovers the transmission mechanism to drive the second feeding roller.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 3:
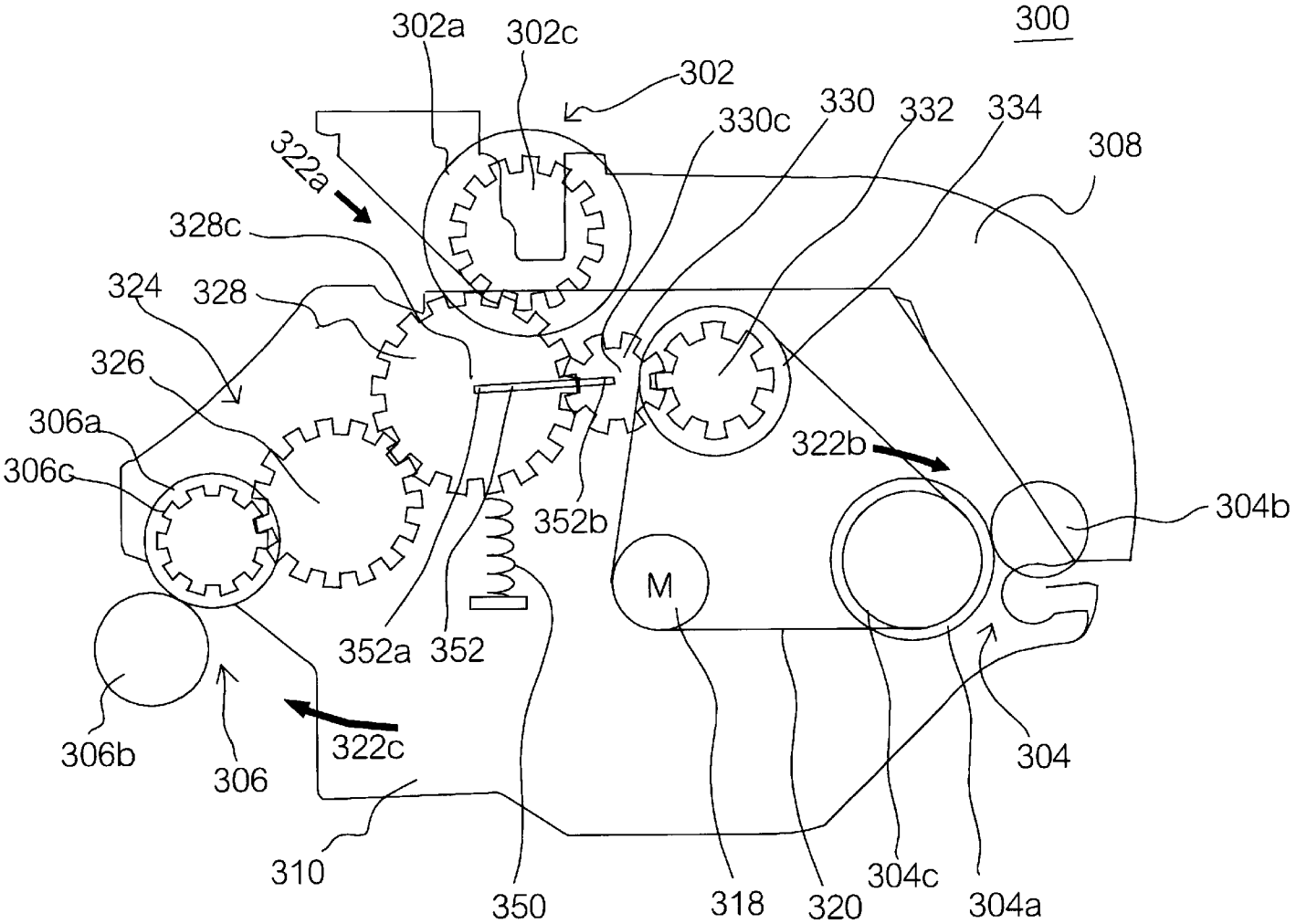
FIG. 3 shows the cross section of an automatic document feeder (ADF) capable of releasing jammed documents according to a preferred embodiment of the invention.

FIG. 3 shows the cross section of an automatic document feeder (ADF) capable of releasing jammed documents according to a preferred embodiment of the invention. The ADF 300 includes an upper cover 308 and a main body 310 in appearance. The ADF 300 further includes at least three roller sets inside the main body 310, which are an ADF roller set 302, a first feeding roller set 304, and a second feeding roller set 306. While the document is forwarded, it is transmitted along the transmission directions 322*a*, 322*b*, and 322*c* and is passed through the ADF roller set 302, the first feeding roller set 304, and the second feeding roller set 306, sequentially.

The ADF roller set 302 includes a roller 302*a* and a gear 302*c*. The roller 302*a* and the gear 302*c* have the same shaft. The gear 302*c* is driven directly by the motor 318 or indirectly via other gears or a transmission belt. The first feeding roller set 304 preferably includes a roller 304*a* and an idle pulley 304*b* rotatably mounted to the upper cover 308 of the ADF. The roller 304*a* can be connected to a pulley 304*c*, wherein the roller 304*a* and the pulley 304*c* have the same shaft. The pulley 304*c*, roller 304*a*, and idle pulley 304*b* are driven by the motor 318 through a transmission device such as a transmission belt 320. Thus, the document can be transmitted to the second feeding roller set 306 along the direction indicated by the arrow 322*c*. The second feeding roller set includes a fixed idle pulley 306*b* and a roller 306*a*. The roller 306*a* can be driven by the motor 318 through a gear 306*c*, wherein the roller 306*a* and the gear 306*c* have the same shaft. The gear 306*c* is further driven through a transmission mechanism 324. The transmission mechanism 324 can be any combination of the gear, transmission belt, or pulley. The number of each device (the gear, transmission belt, or pulley) is not limited and not every device is required to form the transmission mechanism 324. A combination of only one kind or two kinds of the above-mentioned device is also within the scope of the invention only if the transmission mechanism 324 is able to transmit the second feeding roller set 306.

According to the preferred embodiment of the invention, as shown in FIG. 3, the transmission mechanism 324 of the second feeding roller set contains a gear 326, a gear 328, a gear 330, a gear 332, a pulley 334 which shares the shaft with the gear 332, and a belt 320. A disconnecting device, preferably an elastic device 350, such a spring or a leaf spring, is added to the ADF 300 to facilitate the removal of jammed paper in the second feeding roller set 306. The elastic device 350 works to disconnect the transmission mechanism 324 by pushing a removable gear away from the entire transmission mechanism 324, when the upper cover 308 is opened. The removable gear can be any device of the transmission mechanism 324. In FIG. 3, a gear 328 is taken as an example of the removable device. However, the removable device is not limited to the gear. On the contrary, any removable device of the transmission mechanism 324, which can be pushed away by the elastic device 350 from the transmission mechanism 324 so that the transmission mechanism 324 can be disconnected, is within the scope of the invention. In FIG. 3, the elastic device 350 can be, for example, disposed under the gear 328. The gear 328 can therefore be pushed away by the elastic device 350 when the upper cover 308 is opened.

Further more, the removable device, such as the gear 328, is not fixed at the main body 310 but is connected to the adjacent device, such as the gear 330, by a connecting rod 352. The connecting rod 352 is an apparatus facilitating to disconnect and recover the transmission mechanism. One end 352*a* of the connecting rod 352 is connected to the center 328*c* of the gear 328 while the other end 352*b* of the connecting rod 352 is connected to the center 330*c* of the gear 330.

Thus, when the upper cover 308 is opened, the elastic device 350 pushes the gear 328 away and the connection of the motor 318 and the second feeding roller set 306 is cut off. The removable device, the gear 328, is then called in an away status. Similarly, while the upper cover 308 is closed, the removable device can be pushed back into the position from where it is pushed away and be mounted with the adjacent devices precisely. The removable device, the gear 328, is then called in a working status.

The spirit of the invention is to disconnect the transmission mechanism between the motor and the second feeding roller set, so that damping generated by the motor and the enhancement thereof resulted from the speeding-low design of the gears can be prevented. Thus, the spirit of the invention is not limited to the application in the ADF as shown in FIG. 3 but can be applied in any other types of ADFs.

Figure 4:
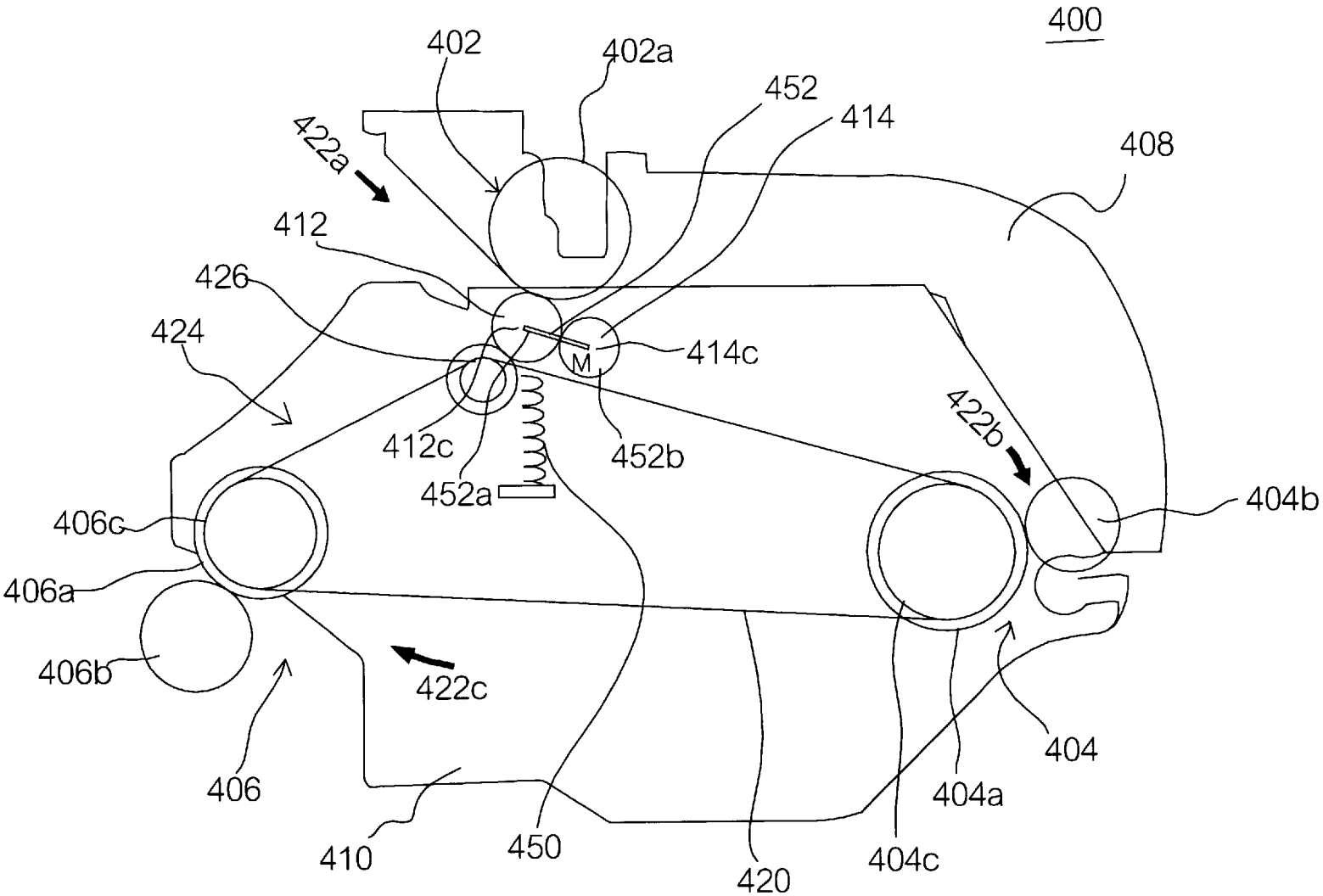
FIG. 4 shows the cross section of another ADF capable of releasing jammed documents according to a preferred embodiment of the invention.

FIG. 4 shows the cross section of another ADF capable of releasing jammed documents according to a preferred embodiment of the invention. The ADF 400 contains an upper cover 408 and a main body 410 in appearance. Further more, the ADF 400 includes at least three roller sets in the main body 410: an ADF roller set 402, a first feeding roller set 404, and a second feeding roller set 406. When the document is forwarded, it is transmitted along the transmission directions 422*a*, 422*b*, and 422*c* and is passed through the ADF roller set 402, the first feeding roller set 404, and the second feeding roller set 406, sequentially.

The ADF roller set 402 includes at least a roller 402*a*. The motor 414 drives the transmission roller 402*a* through a transmission device 412, such as a gear, a pulley, or a belt so that the document can be forwarded to the ADF 400. The first feeding roller set 404 preferably includes a roller 404*a* and an idle pulley 404*b* rotatably mounted on the upper cover 408 of the ADF 400. The roller 404*a* can be connected to a pulley 404*c* by the same shaft. By the transmission of a transmission device such as a transmission belt 420, a pulley 404*c*, a roller 404*a*, and an idle pulley 404*b* are driven by the motor 414. Thus, the document can be further forwarded to the second feeding roller set 406 along the direction indicated by the arrow 422. The second feeding roller set 406 includes a fixed idle pulley 406*b* and a roller 406*a*. The roller 406*a* can be driven by transmission mechanism, which is a combination of gear or a transmission belt.

According to a preferred embodiment of the invention, the transmission mechanism 424 of the second feeding roller set 406 includes a pulley 406*c* which shares the shaft with the roller 406*a*, a transmission device 426, a transmission device 412, and a belt 420. According to the spirit of the invention, an elastic device 450, such as a spring or a leaf spring, is disposed. The elastic device 450 pushes a removable transmission device away from the transmission device 424 and thus disconnects the transmission device 424, when the upper cover 408 is opened. The removable transmission device is then called in an away status.

As shown in FIG. 4, the transmission device 412 is designed as a removable transmission device. However, it is apparent for people skilled in this art that the invention is not limited thereto. On the contrary, any transmission device of the transmission mechanism of the second feeding roller set can be designed as a removable device. A disconnecting apparatus, preferably an elastic device 450, is disposed under or near the removable device, such as the removable transmission device 412. The removable transmission device is pushed away from the transmission mechanism of the second feeding roller set 406 and thus the transmission mechanism thereof is disconnected when the upper cover 408 is opened. The removable transmission device is then called in an away status.

According to the spirit of the invention, the removable transmission device, such as the transmission device 412, is not fixed at the main body 410 but is connected to the adjacent device, such as the motor 414, by a connecting rod 452. The connecting rod 452 is an apparatus facilitating to disconnect and recover the transmission mechanism. One end 452*a* of the connecting rod 452 is connected to the center 412*c* of the transmission device 412 while the other end 452*b* of the connecting rod 452 is connected to the center 414*c* of the motor 414.

Thus, when the upper cover 408 is closed, the removable device can be pushed back into the position from where it is pushed away and be mounted with the adjacent devices precisely. The removable transmission device 412 is then called in a working status.

The spirit of the invention is mainly to disconnect the transmission mechanism between the motor and the second feeding roller set and so that the damping generated by the motor and the enhancement thereof resulted from the speed down design of the gears can be prevented. Thus, any device capable of disconnecting the transmission mechanism when necessary is within the scope of the invention but not limited in the elastic device stated above. What follows is an example of another kind of disconnecting device to cut off the transmission of the second feeding roller set when necessary.

Figure 5:
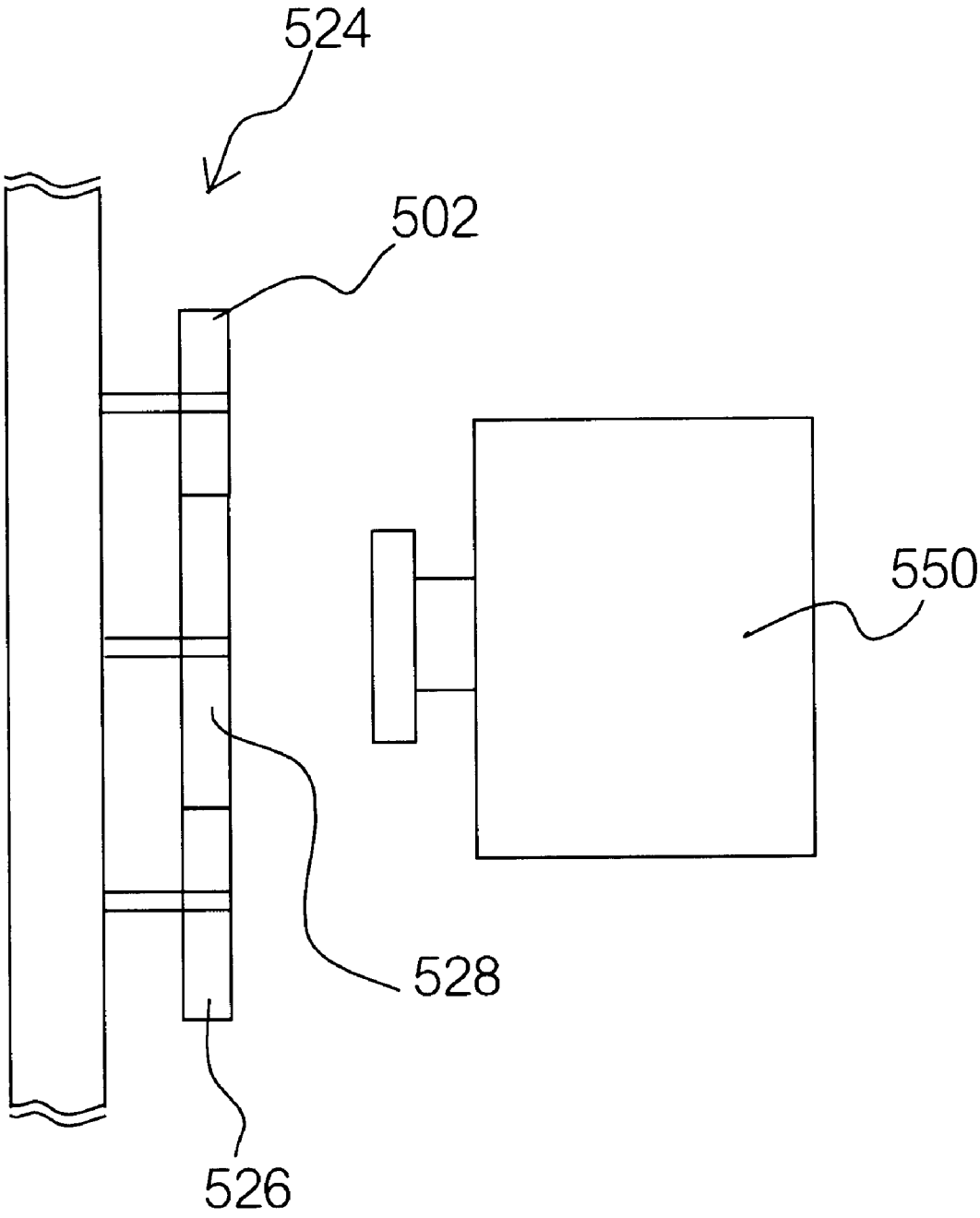
FIG. 5 is a cross section of a portion of an ADF according another preferred embodiment of the invention.

FIG. 5 is a cross section of a portion of an ADF according another preferred embodiment of the invention. The transmission mechanism 524 between the feeding roller set and motor includes a transmission device 502, a transmission device 528, and a transmission device 526. The transmission devices 502, 528, and 526 can be gears mounted with each other, similar to the gears 302, 328, and 326 as shown in FIG. 3. Also, the transmission devices 502, 528, and 526 can be similar to the roller 402*a*, transmission device 412, and the transmission device 426 as shown in FIG. 4.

According to another preferred embodiment of the invention, the ADF as shown in FIG. 5 includes a disconnecting apparatus, preferably an electromagnetic switch 550. The electromagnetic switch 550 is able to attract a removable transmission device away from the transmission mechanism 524. While the removable transmission device is attracted away from the transmission mechanism 524, the transmission mechanism 524 is disconnected and the jammed documents in the feeding roller set can be easily removed. Moreover, by using the electromagnetic switch 550, the removable transmission device can be pulled back and the transmission mechanism 524 is able to function as transmitting the transmission mechanism 524 while the jammed paper is removed. In FIG. 5, the transmission device 528 is designed as the removable transmission device. However, according to the spirit of the invention, any transmission device of the transmission mechanism 524 but not only the transmission device 528 can be designed as a removable transmission device.

Figure 6:
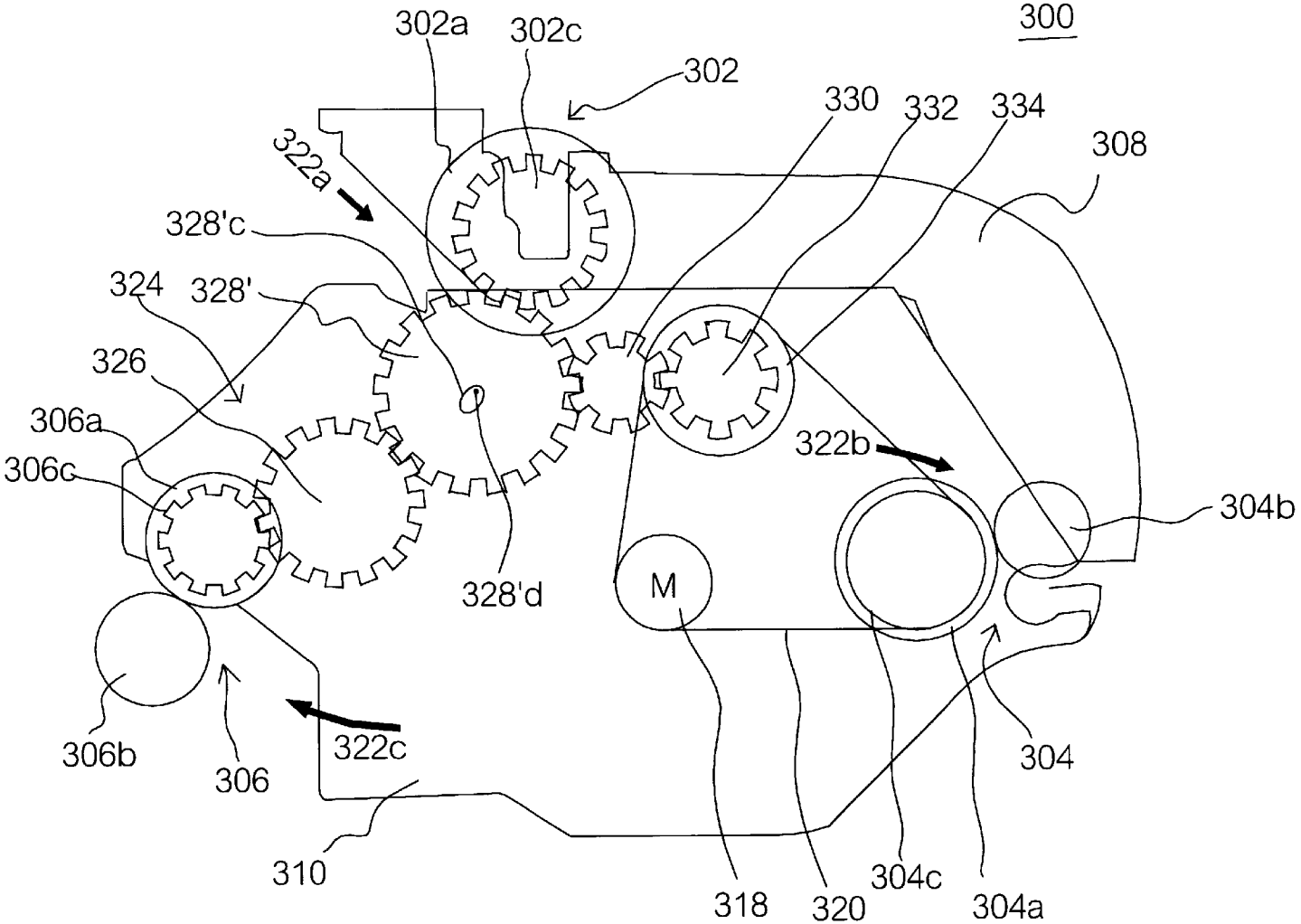
FIG. 6 shows the cross section of another ADF capable of releasing jammed documents according to another preferred embodiment of the invention.
Figure 7:
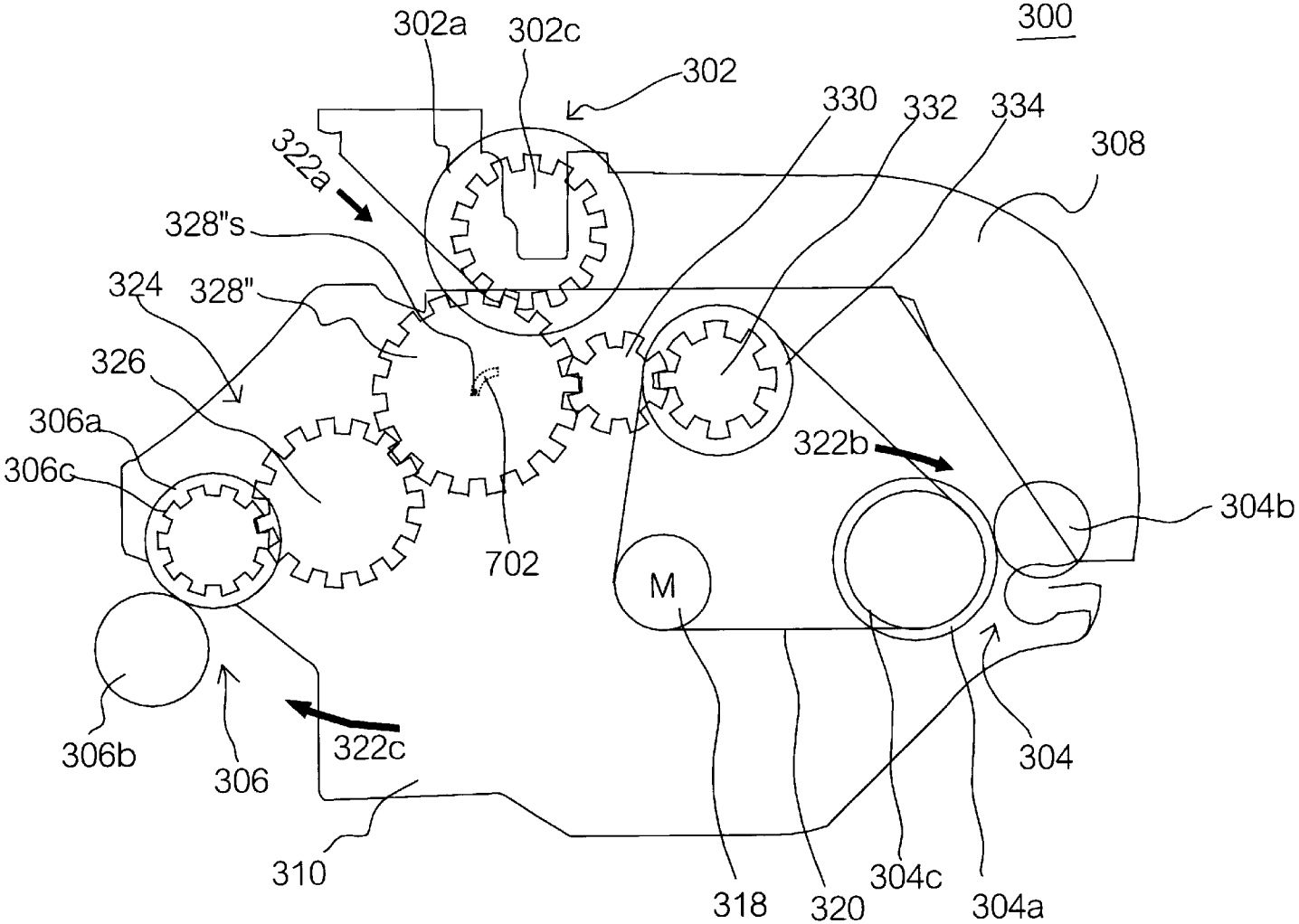
FIG. 7 shows the cross section of another ADF capable of releasing jammed documents according to another preferred embodiment of the invention.

Moreover, the ADFs shown in FIG. 6 and FIG. 7 are also designed to be able to disconnect the transmission mechanism of the second feeding roller set and are therefore within the scope of the invention.

FIG. 6 shows the cross section of another ADF capable of releasing jammed documents according to a preferred embodiment of the invention. The removable gear 328' has a central hole 328'*c*, wherein the central hole 328'*c* is larger than the cross-section of the shaft 328'*d* of the removable gear 328'. The central hole 328'*c* is preferably in an ellipse shape extending along the direction in which the upper cover 308 is opened. The shaft 328'*d* of the removable gear 328' is fixed at the main body 310 and penetrates through the central hole 328'*c* of the removable gear 328' to support the removable gear 328'. When the upper cover 308 is opened, the removable gear 328' is in an away status. The force to remove the jammed documents indirectly motivates the gear 302*c* and the gear 320 and consequently, the removable transmission gear 328' moves upwards and away from the transmission mechanism 324. Therefore, the connection of the motor 318 with the feeding roller set 306 is cut off. While the upper cover 308 is closed, the removable gear 328' is indirectly pushed back to its original position and is in a working status. While the removable gear 328' is in the working status, the removable gear 328' is well connected to the adjacent transmission devices. Consequently, the motor 318 can again drive the feeding roller set 306 through the transmission mechanism 324.

FIG. 7 shows the cross section of another ADF capable of releasing jammed documents according to a preferred embodiment of the invention. The ADF according to a preferred embodiment of the invention has a slot 702 for disposing the shaft 328"*s* of the removable gear 328". When the upper cover 308 is opened, the removable gear 328" is in an away status. The force to remove the jammed documents indirectly motivates the removable gear 328" to move upwards and away from the transmission mechanism 324 along the slot 702. Therefore, the connection of the motor 318 and the feeding roller set 306 is cut off. While the upper cover 308 is closed, the removable gear 328" is indirectly pushed back to its original position and is called in a working status. While the removable gear 328" is in the non-movable status, the removable gear 328" is well connected to the adjacent transmission devices. Consequently, the motor 318 can again drive the feeding roller set 306 through the transmission mechanism 324.

Figure 1:
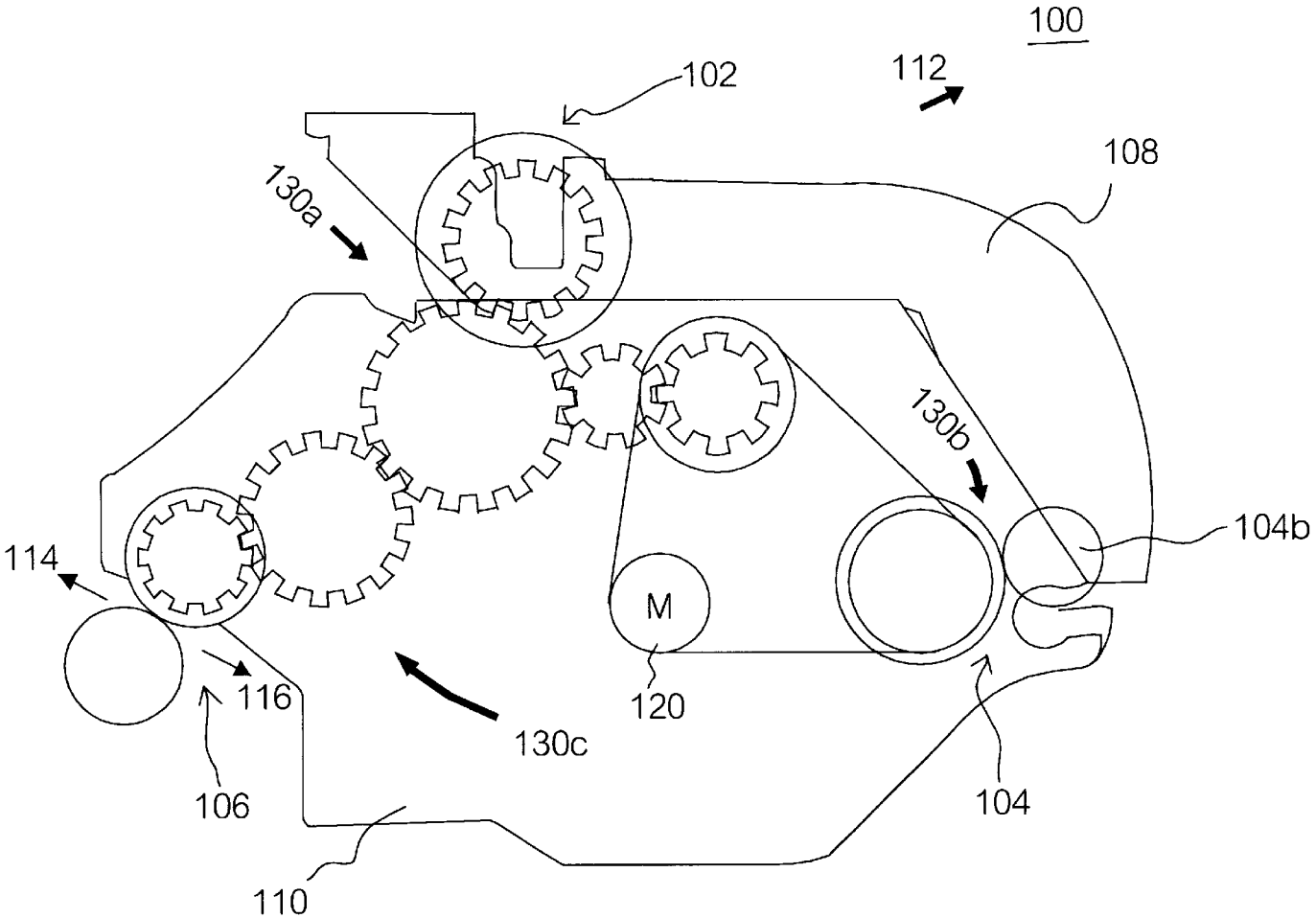
FIG. 1 (PRIOR ART)
FIG. 1 (Prior Art) is a schematic illustration showing a conventional ADF.
Figure 2:
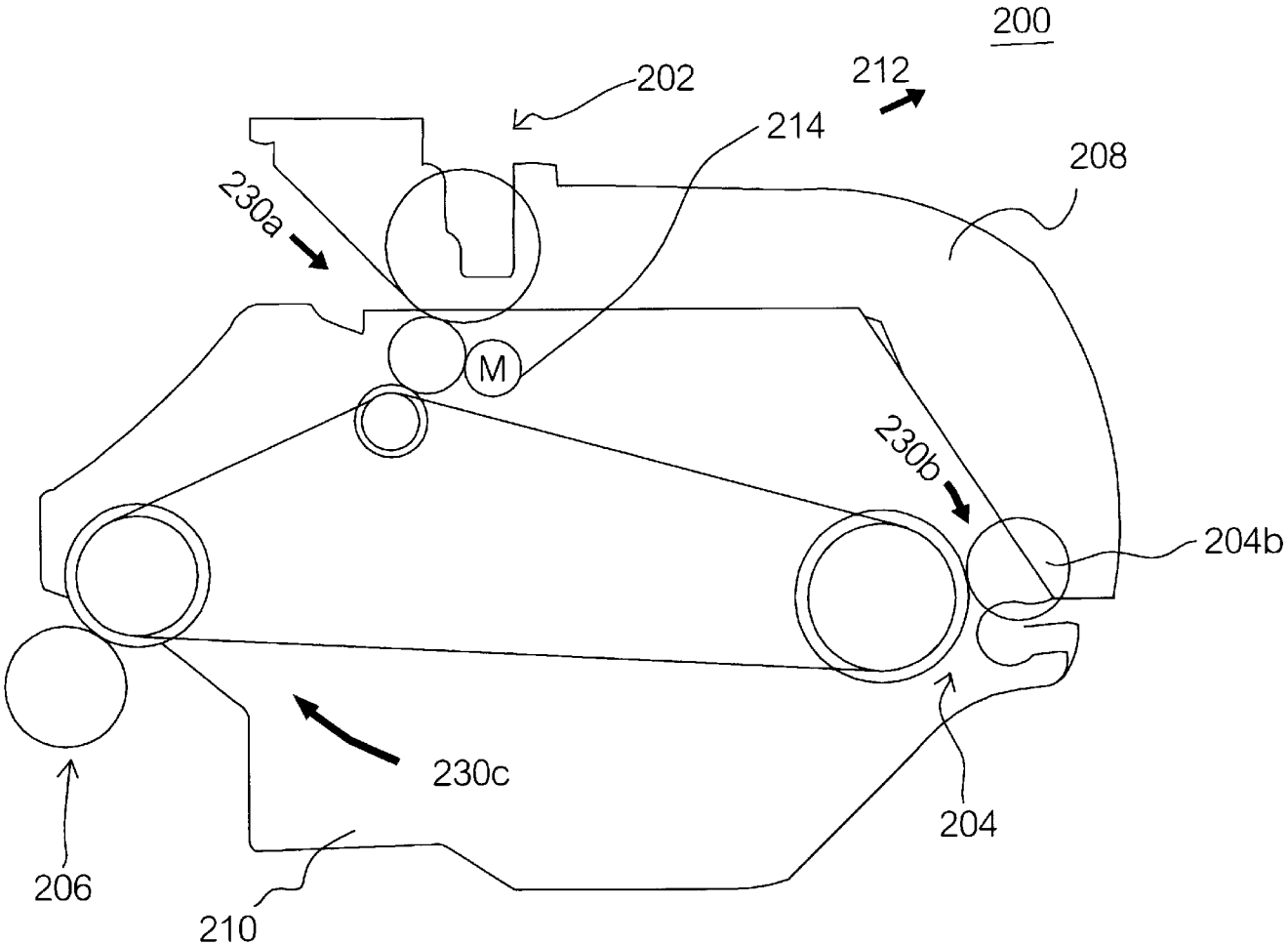
FIG. 2 (PRIOR ART)
FIG. 2 (Prior Art) is a schematic illustration showing another conventional ADF.

The ADFs as shown in FIG. 6 and FIG. 7 are illustrated by taking the conventional ADF in FIG. 1 as an example. However, the central hole of the removable transmission device design and the slot of the ADF design are not limited thereto. On the contrary, the two designs of the invention can also be applied to the ADF shown in FIG. 2 and any other types of ADF.

Figure 8:
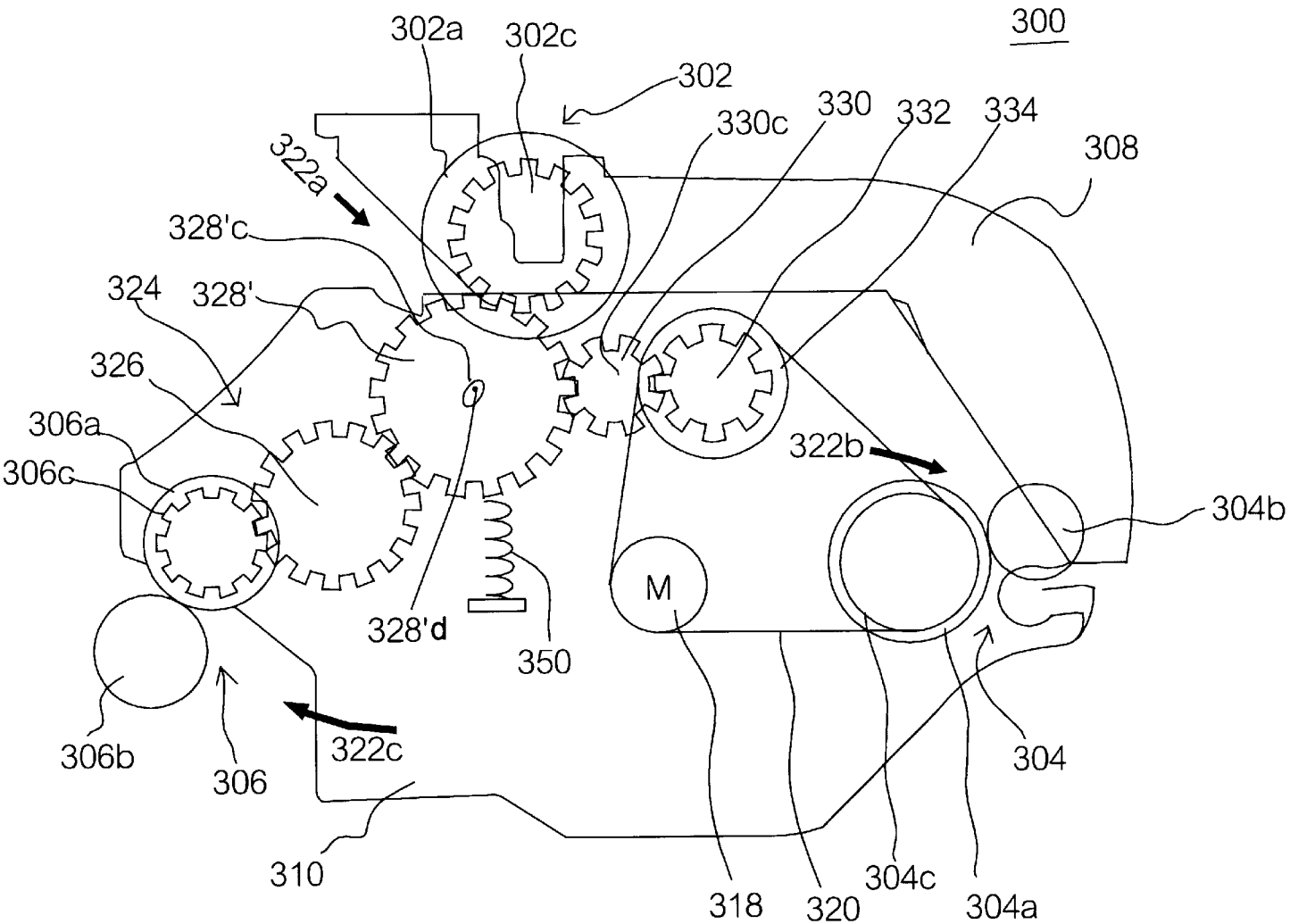
FIG. 8 shows the cross section of another ADF capable of releasing jammed documents according to another preferred embodiment of the invention.

The central hole of the removable transmission device design and the slot of the ADF design can successfully remove the removable transmission device away from the transmission mechanism and disconnect the transmission mechanism. Moreover, these two designs can be further optimized by adding an elastic device near the removable transmission device, as shown in FIG. 8. The combination thereof is therefore within the scope of the invention.

Similarly, the elastic devices as shown in FIG. 3 and FIG. 4 are preferred but not necessary devices. The removable transmission device can be spontaneously pushed away from the transmission mechanism while the upper cover is opened and be indirectly pushed back while the upper cover is closed by the aid of the connecting rod.

To sum up, the ADF capable of releasing jammed documents according to preferred embodiments of the invention has the following advantages.

1. It is able of reducing the enhancement of damping resulted from the speed down design of the gears. Thus, the document jammed in the roller set which is directly or indirectly connected to the motor can be easily removed and torn-off document will be left in the ADF.

2. All roller sets can be released in one single step. Thus, users can easily resolve the problem of paper jam without extra learning.

3. It is capable of resolving the problem of paper jam by a simple design. The ADF of the invention has a simple design, low cost, low breakdown rate, high yield and reliability.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An automatic document feeder (ADF) capable of releasing jammed documents, the ADF comprising:

a main body;

an upper cover openably attached to the main body;

a feeding roller set rotatably mounted to the main body for feeding documents out; and a transmission mechanism connecting the feeding roller set to a motor that drives the feeding roller set through the transmission mechanism, the transmission mechanism comprising a removable transmission device having an away status, in which the upper cover is opened, the removable transmission device is away from the transmission mechanism, and the transmission mechanism is disconnected so that jammed documents can be removed easily, and having a working status opposite to the away status.

2. The ADF capable of releasing jammed documents as claimed in claim 1, wherein when the removable transmission device is in the away status, the removable transmission device is removed and the transmission mechanism is disconnected indirectly by a force for removing the jammed documents.

3. The ADF capable of releasing jammed documents as claimed in claim 2, wherein the transmission mechanism further comprises an adjacent device adjacent to the removable transmission device and the ADF further comprises:

a connecting rod having a first end connected to the removable transmission device and a second end connected to the adjacent device so that the removable transmission device can move backwards and forwards.

4. The ADF capable of releasing jammed documents as claimed in claim 1, wherein the removable transmission device is a removable gear.

5. The ADF capable of releasing jammed documents as claimed in claim 4, wherein the removable gear comprises a central hole and a shaft, the central hole is larger than a cross section of the shaft, the shaft of the removable gear is fixed at the ADF and penetrates through the central hole to support the removable gear, and when the removable gear is in the away status, the removable gear is pushed away from the transmission mechanism along the central hole and the transmission mechanism is disconnected by the force for removing the jammed documents.

6. The ADF capable of releasing jammed documents as claimed in claim 4, wherein the ADF comprises a slot for disposing a shaft of the removable gear, and while the removable gear is in the away status, the removable gear is pushed away from the transmission mechanism along the slot and the transmission mechanism is disconnected by the force for removing the jammed documents.

7. The ADF capable of releasing jammed documents as claimed in claim 1, wherein while the removable transmission device is in a working status, the motor is able to drive the feeding roller set through the transmission of the transmission mechanism.

8. The ADF capable of releasing jammed documents as claimed in claim 1, further comprising a disconnecting apparatus for removing the removable transmission device so that the transmission mechanism is disconnected.

9. The ADF capable of releasing jammed documents as claimed in claim 8, wherein the disconnecting apparatus comprises:

an elastic device for pushing the removable transmission device away from the transmission mechanism so that the transmission mechanism is disconnected.

10. The ADF capable of releasing jammed documents as claimed in claim 9, wherein the transmission mechanism further comprises an adjacent device adjacent to the removable transmission device and the disconnecting apparatus further comprises:

a connecting rod having a first end connected to the removable transmission device and a second end connected to the adjacent device so that the removable transmission device can move backwards and forwards.

11. The ADF capable of releasing jammed documents as claimed in claim 9, wherein the removable transmission device is a removable gear.

12. The ADF capable of releasing jammed documents as claimed in claim 11, wherein the removable gear comprises a central hole and a shaft, the central hole is larger than a cross section of the shaft, the shaft of the removable gear is fixed at the ADF and penetrates through the central hole to support the removable gear, and when the removable gear is in the away status, the removable gear is pushed away from the transmission mechanism along the central hole and the transmission mechanism is disconnected by the elastic apparatus.

13. The ADF capable of releasing jammed documents as claimed in claim 11, wherein the ADF comprises a slot for disposing a shaft of the removable gear, and when the removable gear is in the away status, the removable gear is pushed away from the transmission mechanism along the slot and the transmission mechanism is disconnected by the elastic apparatus.

14. The ADF capable of releasing jammed documents as claimed in claim 8, wherein the disconnecting apparatus comprises:

an electromagnetic switch, wherein the electromagnetic switch attracts the removable device away from the transmission mechanism to disconnect the transmission mechanism when the removable device is in the away status; and wherein the electromagnetic switch pushes the removable device back to be connected with adjacent devices of the transmission mechanism and to reconnect the transmission mechanism while the removable device is in the working status.

* * * * *